United States Patent [19]

Baumann

[11] Patent Number: 4,493,119

[45] Date of Patent: Jan. 15, 1985

[54] DEVICE FOR THE TREATMENT OF THE EYES WITH A WASHING OR BATHING LIQUID

[76] Inventor: Ludwig G. Baumann, Reckholder, CH-9527 Niederhelfenschwil, Switzerland

[21] Appl. No.: 456,406

[22] Filed: Jan. 7, 1983

[30] Foreign Application Priority Data

Jan. 9, 1982 [DE] Fed. Rep. of Germany ..... 3200472

[51] Int. Cl.[3] ..... A61H 33/00; A61H 33/04; E03C 1/05; E03C 1/02

[52] U.S. Cl. ..... 4/620; 4/624; 128/66; 128/24 R; 239/590.3; 604/296; 604/301

[58] Field of Search ..... 4/620, 624; 239/28, 239/29, 29.3, 543, 544, 30, 590.3; 128/249, 66, 239, 24 R; 604/48, 296, 294, 301

[56] References Cited

U.S. PATENT DOCUMENTS

| | | | |
|---|---|---|---|
| 1,079,064 | 11/1913 | Peters | 128/24 R |
| 1,121,667 | 12/1914 | Ross | 604/301 X |
| 1,350,719 | 8/1920 | Galligan | 604/301 |
| 1,692,143 | 11/1928 | Strunz | 604/301 |
| 1,900,201 | 3/1933 | Sager | 604/296 |
| 2,482,960 | 9/1949 | Benson | 4/620 |
| 2,775,774 | 1/1951 | Logan | 4/620 |
| 2,793,641 | 5/1957 | Bouchacourt | 604/48 |
| 2,818,068 | 12/1957 | De Felice | 604/296 |
| 3,090,050 | 5/1963 | Fraser et al. | 4/620 |
| 3,261,355 | 7/1966 | Burbig | 604/296 |
| 3,413,660 | 12/1968 | Lagarelli et al. | 4/620 |
| 3,599,251 | 8/1971 | Wright | 4/620 |
| 3,629,876 | 12/1971 | Wright | 4/620 |
| 3,809,315 | 5/1974 | Wright | 4/620 X |
| 3,925,829 | 12/1975 | Bost | 4/620 X |
| 4,012,798 | 3/1977 | Liautaud | 4/620 |
| 4,363,146 | 12/1982 | Liautaud | 4/620 |

FOREIGN PATENT DOCUMENTS

| | | |
|---|---|---|
| 479097 | 8/1959 | Fed. Rep. of Germany . |
| 258253 | 4/1960 | Fed. Rep. of Germany . |
| 611966 | 10/1960 | Fed. Rep. of Germany . |
| 8068509 | 6/1961 | Fed. Rep. of Germany . |
| 1282229 | 11/1968 | Fed. Rep. of Germany . |
| 7510968 | 7/1975 | Fed. Rep. of Germany . |
| 2653922 | 6/1978 | Fed. Rep. of Germany . |

*Primary Examiner*—Henry K. Artis

*Attorney, Agent, or Firm*—Manfred M. Warren; Robert B. Chickering; Glen R. Grunewald

[57] ABSTRACT

The device for the treatment of the eyes with a washing or bathing liquid consists of a container, which possesses a cover, in which are located two vertical whirlpool tubes as washing devices, spaced to accommodate the two eyes, in the interior cross section of which is located a whirlpool device to generate bubbles as in the manner of a whirlpool bath. The cover carries the whirlpool tubes with intake. Only the washing liquid is located in the container.

4 Claims, 6 Drawing Figures

DEVICE FOR THE TREATMENT OF THE EYES WITH A WASHING OR BATHING LIQUID

BACKGROUND OF THE INVENTION

A device as named above is familiar in various embodiments. The object of DE-AS No. 26 39 449 made known the possibility of treating the eyes with a washing or bathing liquid in such a manner that a stream of liquid is directed at the eyes by means of spray nozzles located in a catch basin.

DE-PS No. 889 683 revealed a similar arrangement, in which a stream of liquid is directed vertically up at the eyes. The stream of liquid running down from the face is caught in a funnel-shaped device.

Similar arrangements were revealed also in U.S. Pat. No. 3,629,876 and DE-PS No. 882 470. All these devices have in common that the eyes are treated by a stream of liquid under pressure, with the purpose of rinsing out foreign bodies that may be present in the area of the eye or to clean the eyes of a dangerous substance.

It has been medically proven that numerous eye complaints are the result of poor circulation and oxygen starvation to the eyes. Just as in a whirlpool bath the supply of oxygen-rich air to the bathing body is accomplished, gentle whirlpool treatment of the eyes by means of air whirlpool massage baths can also cause—in addition to a gentle massage effect—an increase in the supply of oxygen-rich air during the eye bath.

SUMMARY OF THE INVENTION

The object of the invention is to create a device for eye hygiene which applies a gentle micromassage to the eyes by means of an effervescent bathing fluid and is simultaneously so designed that it can easily be taken on trips, can be manufactured simply and cheaply, is easy to clean, can be altered to suit various applications and can be manufactured simply and easily.

In the solution of this task, the invention presupposes a device for the treatment of the eyes with a washing or bathing liquid, which is located in a portable container, which simultaneously serves to support the head and has a washing arrangement for each eye.

This arrangement, which is basically familiar and has been described in DE-AS No. 26 39 449, is improved in a manner essential to the invention by providing the container with a cover, in which are located two vertical whirlpool tubes as washing devices, spaced to accommodate the two eyes, in the interior cross section of which is located a whirlpool device, to generate bubbles as in the manner of a whirlpool bath.

The combination of a container with a cover permits design of the container solely for the purpose of holding the washing liquid, while the cover holds the whirlpool devices, i.e. provision of air tubes, etc.

It is essential to the invention that the cover which carries the whirlpool tubes has forehead supports.

With this design a device has been created which can be taken on trips and which can also be used at home, because the user of the device can use attachments connected to the cover which locate the eyes in the whirlpool tubes or with eye basins connected to them, by means of the forehead support, so that an optimal result is achieved.

Further characteristics essential to the invention are described in the claims and in the description. It is also essential that an air generator for the air bubbles be provided in an air generator housing, either as a separate unit or in one piece with the container, the cover of which carries the whirlpool tubes. This provides for all possibilities, if one wished to vary the device in a modular way, e.g. by the use of other air generators or by adding further devices.

It is also efficient, if the design is such that the whirlpool tubes can be sealed with covers, e.g. after the eye supports have been removed, so that the washing liquid need not always be poured out and the device can be used for transport purposes, as the need may arise on trips.

In view of the sensitivity of the eyes, it is of the greatest importance to insure that the eyes are constantly completely immersed in the bubbling water, while undergoing the whirlpool bath, in order to prevent them from being exposed to a stream of air only from the whirlpool device.

One embodiment of the invention provides further that one eye at a time can be treated, with the entire whirlpool force directed at one eye, which may be necessary in the case of foreign bodies in the eye, in industrial accidents and the like.

In addition, it is to be preferred that the eye whirlpool bath consist of a whirlpool vessel, which has a watertight connection with two vertical bathing tubes, adjacent but spaced to accommodate the two eyes, whereby a whirlpool device is located in the inside diameter of each bathing tube. The user sets his eyes, looking down, on the upper opening of the bathing tubes, whereby—as in the description above—it is essential that the level of bathing liquid be high enough to completely cover the two eyes (that is, including the area of the lid).

On the one hand, the eyes and the lid areas should be completely immersed in the bathing liquid, but on the other hand, the bathing liquid should be prevented from lapping up over the top of the bathing tubes and running out. To this end, a further development of the invention provides for a seal between the eye area (eye sockets) of the user and the upper end of each bathing tube. Such a seal can be effected in various ways.

A first embodiment provides that the upper end of each bathing tube is provided with a support ring that is relatively soft and elastically spring-loaded in the axial direction. The support ring seals against the head of the user, when he sets his eye over the tube, so that the bathing liquid is prevented from spilling out and wetting the user's head. The elastically spring-loaded and relatively soft support rings can be connected to the bathing tube by means of adhesive or of a screw connection (with O-rings). It is equally possible to design the bathing tube in one piece with such a support ring. The bathing tube itself is then designed as a spring-loaded elastic bellows.

A third embodiment provides for disk-shaped support rings, whereby each support ring again consists of a soft, elastically spring-loaded material, e.g. neoprene rubber, water-repellent foam or a pure rubber material.

The support disk is sealed at its outer edge to an additional support ring which is firmly connected to the upper end of the bathing tube. Each support disk is provided with an opening, the diameter of which is so selected that the eyeball barely fits. The opening is eccentric with respect to the mid-axis of the support ring, so that turning the support ring adjusts the distance between the openings in the two bathing tubes, so that an individual adjustment for the spacing of each user's eyes is possible.

In a further development of the invention, the whirlpool device is located in the whirlpool vessel in such manner that it can be adjusted in height, in order to adjust the intensity of the bubbling action (the kinetic energy of the air bubbles striking the eye).

In this regard, a further development of this inventive idea provides for connection of each support ring to the whirlpool device by means of an axially adjustable threaded rod. Thus, by turning the support ring one can adjust the distance between the whirlpool device and the support ring.

The object of the present invention is derived not only from the objects of the individual patent claims, but also from the combination of the individual patent claims among themselves. All information and all features revealed in the accompanying documents, in particular the three-dimensional realization shown in the drawings, are claimed as essential to the invention, insofar as they are novel, either separately or in combination.

In the following the invention is more closely clarified with respect to drawings illustrating several embodiments. Further essential characteristics and advantages of the invention are to be derived from the drawings and their description.

DETAILED DESCRIPTION OF THE INVENTION

Figure 1:
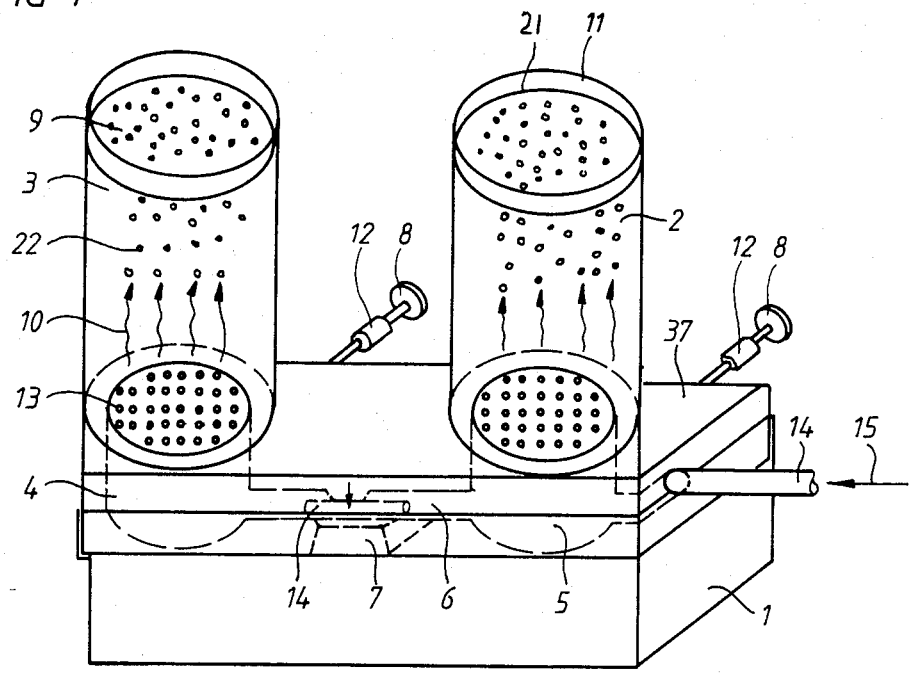
FIG. 1 shows a schematized view of an eye whirlpool bath according to the invention in a first embodiment.

In FIG. 1 a whirlpool vessel 1 is represented, which is preferably made of plastic. Two bathing tubes 2,3 are connected in a watertight manner with the upper cover 37 of the whirlpool vessel 1.

Each bathing tube consists of a cylindrical or conic vertically upright vessel, which is filled to a point just under the upper rim with the washing or bathing liquid 21. The upper rim of the bathing tube or whirlpool tube 2,3 is formed in each case by a support ring 11, which has a sealed connection to the upper end of each bathing tube 2,3. Such a connection can be made by adhesive or threaded fasteners (cap nut and O-ring). The support ring 11 consists of a soft and elastic material which is spring-loaded in the axial direction, so that when the lid area (or eye socket) of the user is laid on the upper side of the support ring 11, the latter springs back in the axial direction and the eyeballs are immersed beneath the surface of the water 9.

In the area of each bathing tube 2,3 there is located a whirlpool device 4,5, which is formed as a hollow plastic unit in the embodiment according to FIG. 1, in the upper side of which air exit passages are located in sieve plates 13, 23.

In a preferred embodiment of the invention, the whirlpool passages are located on the surface of the whirlpool device 4,5 in varying spacing. A heavy whirlpool action is to be produced especially in the area of the pupils; for that reason there are more whirlpool passages 13 per unit of area in this portion of the whirlpool device 4,5 than in other portions.

The two whirlpool devices 4,5 are connected by an airtight tube 6, whereby there is an air supply from outside by means of a connector tube 14, into which the compressed air is introduced in the direction of the arrow 15. The compressed air, warmed and enriched with oxygen or ozone as desired, streams from the sieve plates 13,23 in the direction of the arrow 10 and forms air bubbles 22, which move vertically upward in the bathing tubes 2,3 and strike the eyeballs 16 (cf. FIG. 2) as well as the area surrounding the eyeball.

In order to adjust separately the air supply to the left whirlpool device 4, in comparison to the right whirlpool device 5, there is provided as in FIG. 1 an adjustment screw 8 sitting in a stuffing box 12 on the whirlpool vessel 1, the screw sealing against the stuffing box 12, the free front end of which presses on the cross section of the connecting tube 6, the lower part of which lies on a support 7 inside the whirlpool vessel 1. Adjustment of the adjustment screw 8 causes the inside cross section of the connecting tube 6 to be more or less compressed, so that the air supply to the left whirlpool device 4 can be made stronger or weaker and, corresponding to this adjustment, the whirlpool device 5 receives more or less air.

Figure 2:
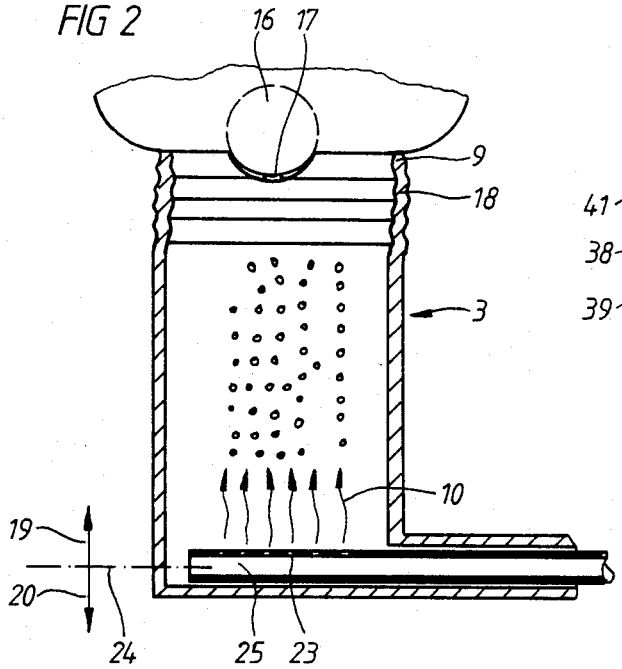
FIG. 2 shows a vertical section through the left bathing tube of an eye whirlpool bath in a second embodiment.

FIG. 2 shows the further emodiment of a bathing tube 3, which in the illustrated example is made in one piece with a support ring 18. The entire bathing tube 3 is thus spring-loaded and compressible in the axial direction, whereby the eye area of the user lies on the upper end of the support ring 18 and seals against it. By altering the pressure applied, the user can determine the depth of immersion of the eyeball 16 into the bathing tube 3.

FIG. 2 shows also the uneven distribution of the air passages 23, whereby it is shown that a heavier whirlpool action is to be attained in the area of the pupils 17 than outside this area.

FIG. 2 shows also that the whirlpool device need not be made of a hollow plastic unit, as in the embodiment according to FIG. 1; rather the whirlpool device shown there 25 consists of a tube provided with whirlpool passages 23.

There is only a schematic representation of the manner in which a height adjustment 24 in the directions of the arrows 19,20 is possible. A constructive design of this height adjustment could consist in connecting the support ring 29 shown in FIG. 3 rigidly to an axially adjustable threaded shaft, which is connected at its other end with the whirlpool device 4,5,25. Turning of the support ring 29 can thus adjust the distance between this support ring 29 and the whirlpool device 4,5,25 in the directions of the arrows 19,20.

Figure 3:
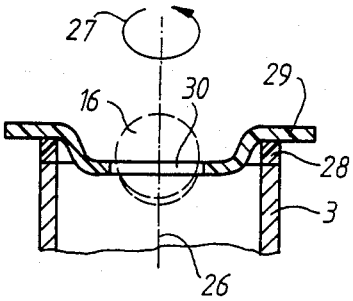
FIG. 3 shows a partial section through the bathing tube of an eye whirlpool bath in a third embodiment.

FIG. 3 shows that it is possible to treat only the eyeball 16 itself, by means of a support ring 29 that is disk-shaped. To this end the support ring 29 is designed as a stepped disk made of a soft and elastic plastic material, which disk has an opening 30 which is eccentric to the turning axis 26, the opening being just large enough to permit the diameter of the eyeball 16 to pass through.

By means of the eccentric arrangement of the opening 30 in the support ring 29, the distance between the openings 30 in the two adjoining bathing tubes with their support rings 29 can be adjusted to correspond to the distance between the eyes of the user. For this purpose the support ring 29 is turned in the direction of the arrow 27.

The support ring 29 can be sealed (e.g. by adhesive) to a gasket 28, which is itself connected by threaded fasteners not shown to the top of each bathing tube 2,3. In the same manner, it is possible to lay the support ring 29 loosely on the gasket 28, whereby the necessary watertight connection is attained by pressing the eye sockets onto the upper end of each bathing tube 2,3.

Figure 4:
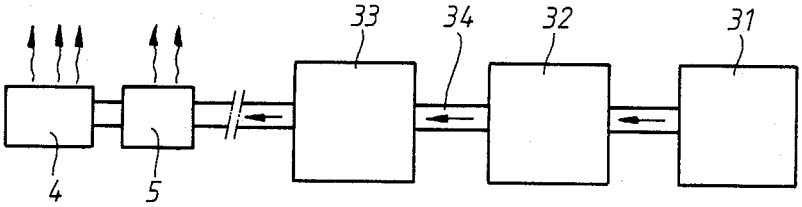
FIG. 4 shows a schematized arrangement of the eye whirlpool bath in a first embodiment.
Figure 5:
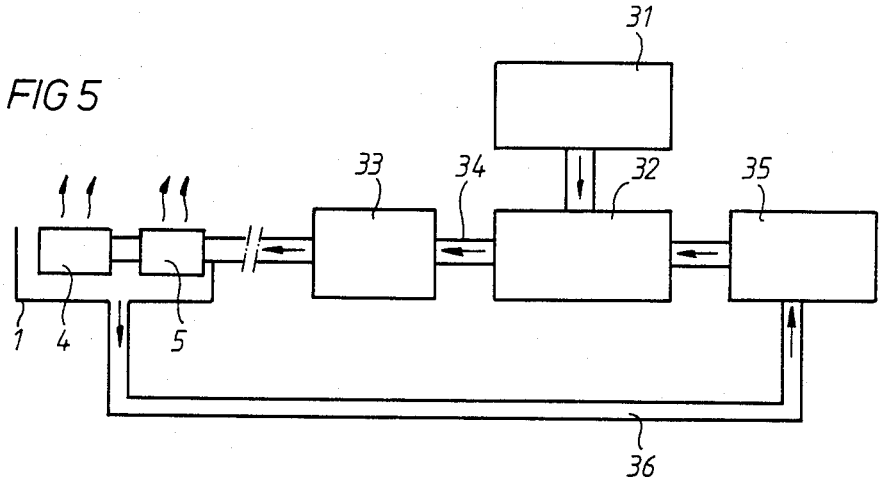
FIG. 5 shows the same representation as in FIG. 4 of an additional embodiment.

The FIGS. 4 and 5 show different mechanical embodiments of a whirlpool device, whereby in the simplest case the air supply in the direction of the arrow 15 at the connecting tube 14 (cf. FIG. 1) can be provided by a hand pump. FIGS. 4 and 5 show in a purely schematic way the individual units of such a whirlpool device, whereby of course all the units are included in one housing, which is preferably attached directly to the whirlpool vessel 1. The connecting tube 14 is omitted in this case.

FIG. 4 shows that a diaphragm pump working as a blower can be used, the pump being either battery-driven or running on house current. In addition, a heater 32 can be provided and, if desired, an ozone supply 33. The illustrated units 33, 32 are optional and can be omitted according to the particular embodiment of the device. The compressed air produced by the diaphragm pump 31 is supplied to the whirlpool device 4,5 by means of a connecting tube 34.

FIG. 5 shows that the bathing liquid can also be recycled; for this purpose there is provided an outlet with a return tube 36, so that the bathing liquid flows in the direction of the arrow out of the whirlpool vessel 1, is moved by a pump 35, is sent on to a heater 32 with accompanying thermostat and is again enriched with compressed air by means of the diaphragm pump 31.

The supply of whirlpool air to the whirlpool device is provided by a small blower or compressor that is not shown, which is either fastened to the wall or connected by an appropriate bracket to the whirlpool vessel 1, whereby the connecting tube 14 passes along the long side of the device to the two bathing tubes, with a security diaphragm along the central axis of the device. It is also important that the bathing liquid circulates throughout the entire whirlpool device, i.e. that there is a connecting channel between the left and right bathing tubes 2,3. If a bracket is used to secure the housing it is preferred to mount the housing diagonally and to provide passages on the outside lower surface of the housing, in case moisture should get inside the housing, so that this liquid can run off unhindered.

The illustrated exmples also do not show that watertight ventilation devices can be located on the upper ends in the area of the support rings, so that extended use does not lead to air stagnation or excessive pressure in the area of the eyeballs 16. In the simplest case such problems are resolved when the user briefly raises his head up from the bathing tubes, in order to let the air out. In another case it is intended to provide float valves, which are not illustrated, which will allow the air to escape without permitting the bathing liquid to pass through such a ventilation device.

In an additional, not illustrated embodiment of the invention, it is intended that not only the eyes may be treated with the present suggested eye whirlpool bath, but that the other sense organs of the face may also be treated, that is the nose and one ear at a time. To this end it is intended that the eye bath cylinder which lies farther from the connecting tube 14 is sealed in a watertight manner at its upper rim, by means of a disk or a screw-on stopper, so that when the above-named sense organs are immersed into the other bathing tube 2 overflowing of the liquid level 9 in the bathing tube 3 is avoided. It is further intended that the above-mentioned support rings 11, 18, 29 can be exchanged for other support rings which are shaped to fit the nose or the ear. The shape must be such that, on the one hand, immersion of the nose or the ear into the liquid is permitted, and, on the other hand, overflowing of the liquid over the rim of the support ring is avoided. Therefore an elastic ring is suggested, which is designed to correspond to the shape of the ear or of the nostril, so that in this manner treatment of the ear or the nose can be carried out.

The whirlpool treatment device 4 of the left bathing tube 3 is turned off by means of the regulating screw 8 and, in addition, the inside diameter of the bathing tube 3 is sealed by means of a watertight stopper.

Figure 6:
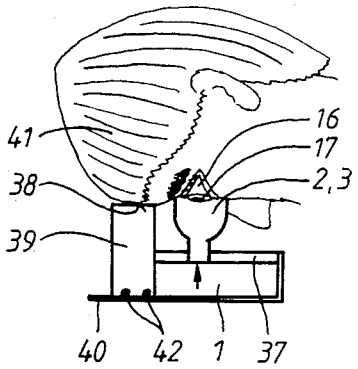
FIG. 6 shows schematically the container with cover and an air generator housing, which simultaneously possesses a forehead support.

FIG. 6 shows the practical application of the device. It can be seen here that the cover 37 is relatively low in comparison to the whirlpool vessel or the container 1. The whirlpool tubes 2,3 shown in FIG. 6 have, for the sake of example, a shape like that of a funnel, in order to permit pouring out of the washing liquid without removal of the cover. Schematically a head 41 is represented, the forehead of which lies on the forehead support 38, while the eyes 16,17 are wetted by the washing liquid. An air generator housing 39, that is, a housing in which the air generator is located, for example the diaphragm pump 31, is separate from the whirlpool vessel in the illustrated embodiment. By means of guide rails 40, it can be moved up to the container 1 and there lock into position, for example. Water outlet opening 42 serves to permit water that may have penetrated the housing 39 to run off. Of course, the housing 39 can also be designed in one piece with the container 1, or the diaphragm pump may be housed in the container 1 itself, whereby if desired this diaphragm pump may operate not only on air, for the production of air bubbles, but also on washing liquid, if that is required by the particular application, e.g. overcoming considerable flow resistance from the liquid, if the holes in the sieve plates are very small and only tiny beads of water are desired. Handles for use and transport are not illustrated.

What is claimed is:

1. A device for treatment of eyes with a washing liquid comprising:

a. a container, two vertical, open topped eye bathing tubes supported by said container, each of said bathing tubes including means around said open tops to create a seal against the face of a user, b. means located within each of said tubes to introduce gas bubbles into a body of liquid contained in said tubes, c. support means on said container and located between said tubes to support the forehead of a user, said support means being located with respect to said tubes to support the forehead of a user when each of the user's eyes is in one of said tubes.

2. The device of claim 1 wherein said seal comprises a spring-loaded support ring made of soft, elastic material.

3. The device of claim 1 wherein said means to introduce gas bubbles includes a compressor and said support is located on said compressor.

4. The device of claim 1 wherein said means to introduce bubbles includes adjustment means to independently cutoff the supply of gas to each of said bathing tubes.

* * * * *